US007275868B2

(12) United States Patent
Miller

(10) Patent No.: US 7,275,868 B2
(45) Date of Patent: Oct. 2, 2007

(54) LAUNDRY RETENTION DEVICE

(76) Inventor: David S. Miller, 11 Lewis Cir., Wilmington, DE (US) 19804

( * ) Notice: Subject to any disclaimer, the term of this patent is extended or adjusted under 35 U.S.C. 154(b) by 0 days.

(21) Appl. No.: 11/145,049

(22) Filed: Jun. 3, 2005

(65) Prior Publication Data

US 2005/0229329 A1 Oct. 20, 2005

Related U.S. Application Data

(60) Division of application No. 10/178,467, filed on Jun. 24, 2002, now abandoned, which is a continuation of application No. 09/901,449, filed on Jul. 9, 2001, now Pat. No. 6,478,464.

(51) Int. Cl.

| | |
|---|---|
| ***B65D 33/28*** | (2006.01) |
| ***B65D 30/04*** | (2006.01) |
| ***B65D 30/06*** | (2006.01) |
| ***A45C 1/04*** | (2006.01) |
| ***A45F 3/00*** | (2006.01) |
| ***F41C 33/02*** | (2006.01) |
| ***F42B 39/02*** | (2006.01) |

(52) U.S. Cl. ..... 383/76; 383/74; 383/117; 383/75; 224/663; 224/665; 224/671; 224/675

(58) Field of Classification Search ..... 8/147, 8/148, 158, 159; 383/107, 117, 22, 24, 39, 383/74, 75, 76; 224/663, 665, 671, 675; 134/172, 173, 176; 239/172

See application file for complete search history.

(56) References Cited

U.S. PATENT DOCUMENTS

| | | | | |
|---|---|---|---|---|
| 1,077,959 | A | | 11/1913 | Gregory et al. |
| 1,493,594 | A | | 5/1924 | Binns |
| 1,597,734 | A | | 8/1926 | Sousa, Jr. |
| 2,317,176 | A | | 4/1943 | Byrd |
| 3,864,790 | A | * | 2/1975 | Reinwall, Jr. ..... 24/129 R |
| 4,228,834 | A | | 10/1980 | Desnick |
| 4,411,267 | A | | 10/1983 | Heyman |
| 4,630,312 | A | * | 12/1986 | Milstein ..... 383/86 |
| 4,713,033 | A | | 12/1987 | Cameron |
| D294,757 | S | | 3/1988 | Kahane et al. |
| 4,884,732 | A | | 12/1989 | Sunderland |
| 4,911,345 | A | | 3/1990 | James et al. |
| 4,923,105 | A | | 5/1990 | Snyder |
| 4,974,709 | A | | 12/1990 | Furlow et al. |
| 4,979,833 | A | | 12/1990 | Cook |
| 5,050,999 | A | | 9/1991 | Van Loon, III |
| 5,060,835 | A | | 10/1991 | Payne |
| 5,150,824 | A | | 9/1992 | Alvarez et al. |
| 5,238,305 | A | | 8/1993 | Feller |
| 5,353,975 | A | | 10/1994 | Libertucci |

(Continued)

*Primary Examiner*—Michael Kornakov
*Assistant Examiner*—Rita R Patel
(74) *Attorney, Agent, or Firm*—Connolly Bove Lodge & Hutz LLP

(57) ABSTRACT

The invention is directed to a laundry retaining device comprising a strap and a bag. The strap is suitable for retaining larger articles of clothing that have openings to pass the strap through, such as shirts and shorts. The bag, preferably a mesh bag, retains smaller articles of clothing or articles that do not have openings to pass the strap through. The device allows for the washing and drying of a set or several sets of clothes at once without having to sort and recreate each set of laundered clothes.

4 Claims, 3 Drawing Sheets

U.S. PATENT DOCUMENTS 5,551,128 A * 9/1996 Townsend ..... 24/302
5,558,440 A 9/1996 Miller
5,704,531 A 1/1998 Nam
5,836,497 A 11/1998 Pelish
D411,671 S 6/1999 Hamblin
6,038,748 A * 3/2000 Durney et al. ..... 24/302
6,070,282 A 6/2000 Underly et al.
6,092,702 A 7/2000 Cassidy, IV
6,095,390 A 8/2000 Bogle
6,174,848 B1 * 1/2001 Dawson et al. ..... 510/297
6,216,933 B1 4/2001 Healy
6,257,406 B1 7/2001 Garino
6,279,799 B1 8/2001 Horton
2005/0242248 A1 * 11/2005 Ryan ..... 248/95

* cited by examiner

LAUNDRY RETENTION DEVICE

CROSS REFERENCE TO RELATED APPLICATIONS

This application is a divisional of application Ser. No. 10/178,467 filed Jun. 24, 2002 now abandoned, which is a continuation application of Ser. No. 09/901,449 filed on Jul. 9, 2001 now U.S. Pat. No. 6,478,464.

INTRODUCTION

The invention is directed to a laundry retention device comprising a strap and a bag. The device provides a convenient means to keep a set of clothes together, including articles of clothing that do not have openings to pass a strap through, such as socks, so that a set or several sets of clothes can be laundered at once without having to sort and recreate the set or sets of laundered clothes.

BACKGROUND OF THE INVENTION

To launder sets of clothing for a group of individuals, such as athletic uniforms, it is necessary to group each set of clothes so that it can be returned to the proper individual. To efficiently launder several sets of clothes at once, a retention device is needed to keep each set of clothes together while the clothes are laundered. With such a device, the clothes can be returned to the individual without having to manually sort through all of the clothing and recreate each set. An important aspect of such a laundry retention device is the ability to securely retain smaller articles of clothing, such as socks. These smaller articles can be the most difficult and time consuming to sort.

There are three general devices known for retaining laundry. These are: (1) a large laundry pin; (2) a mesh bag; and (3) a strap or leash. Each of these devices has drawbacks that makes it unsatisfactory for use with small articles of clothing.

Laundry pins resemble large safety pins that are about five inches in length and are typically made of metal. A laundry pin retains articles of clothing by either passing through an opening in the article or by piercing the article. Articles of clothing that do not have an opening to pass the pin through, such as socks, must be pierced. Articles that are too thick to pass the pin through must also be pierced. Piercing clothes damages the clothing. Another drawback of laundry pins is that the shape causes them to snag and tear other garments when several sets of clothes are laundered at once. Further, because of the size and shape of the pin, the amount of clothes that can be retained with a single pin is limited. Still another limitation of laundry pins is that any identification tag for the clothes must also be attached to the pin.

Mesh bags are conventionally constructed of mesh nylon or similar material. While mesh bags avoid the problems associated with laundry pins, such as the snagging and tearing of clothes, large clothing articles tend to wad up in the bag during washing. The tendency for clothes to wad up in the mesh bags prevents the clothes from being fully cleaned and dried. Also, when a mesh bag is placed in a dryer the clothes tend to become severely wrinkled.

Laundry straps or leashes are suitable for retaining articles of clothing that have openings to pass the strap through so that the strap can be closed to form a loop. The size of the loop allows for larger clothes to be effectively cleaned and dried without causing excessive wrinkling. Additionally, because there are no sharp edges or places to snag, laundry straps do not damage the clothes. However, laundry straps have the inherent problem of being incapable of retaining articles of clothing that do not have openings to pass the strap through, such as socks.

One solution to this inherent drawback of laundry straps is the addition of a second buckle to form a smaller loop with the strap. Such a device is disclosed in Townsend, U.S. Pat. No. 5,551,128 (1996). However, the ability for this type of device to securely retain socks and other small articles of clothing is limited as these articles are only held by the friction between the clothes and the smaller loop.

Another solution to the inherent drawback of laundry straps is the combination of the strap and a loop of cord with a cordlock fastener to retain socks. Such a device is disclosed in Durney et al., U.S. Pat. No. 6,038,748 (2000). However, this device, like that of Townsend, retains small clothes solely by the friction between the clothes and the nylon cord. Both of these devices are known to unsuccessfully retain socks and other small articles of clothing without openings, particularly when the clothes are made from modem synthetic fabrics which do not function well with friction retention systems.

The drawbacks observed in the prior art clearly show that there is a need to provide a laundry retention device that retains socks and other small articles of clothing that do not have openings These drawbacks have been overcome by the inventor through the addition of a relatively small bag attached to a laundry strap. The invention has unexpectedly been found to successfully retain articles of clothing without openings, such as socks, while being able to effectively clean and dry all of the retained articles of clothing. Because the present invention does not retain socks and other small articles of clothing by friction, the invention securely holds clothes made from both natural and, particularly, synthetic fibers.

SUMMARY OF THE INVENTION

The present invention is a device for retaining laundry comprising a strap having opposing strap ends with a fastener to releasably connect the strap ends and a bag, the bag having an opening and a closure to close the opening. The bag is attached to the strap. The strap retains clothes by passing one strap end through openings in the clothes and connecting the strap end to the other strap end using the fastener. The bag retains articles of clothing that do not have openings to pass the strap through, such as socks. The bag is made of mesh, screen, fabric, perforated fabric, or other suitable material known by an ordinarily-skilled artisan to allow the clothes placed inside the bag to be effectively washed and dried. In a preferred embodiment of the present invention, the bag is a mesh bag.

In view of the above, it is an object of the present invention to provide a device to securely retain articles of clothing both with and without openings so that all of the retained clothes can be effectively cleaned and dried together. Effective cleaning and drying involves allowing the clothes to be thoroughly washed and dried. It is an object of the present invention that using the device allows for the retained clothes to be as effectively washed and dried as if the clothes were placed individually, i.e., not retained, into the washer and dryer.

It is another object of the present invention that more than one set of clothes can be simultaneously washed and dried by retaining each set of clothes with a device. It is yet another object of the present invention that an identification tag is attached to the device so that each device and the retained clothes can be easily identified.

Further scope of applicability of the present invention will become apparent from the following detailed description. However, it should be understood that the detailed description of the preferred embodiments of the invention is provided for illustration only. Various changes and modifications within the spirit and scope of the invention will become apparent to an ordinarily-skilled artisan from this detailed description. Therefore, it is understood that both the above general description and the following detailed description are exemplary and explanatory and do not restrict the scope of the claimed invention.

BRIEF DESCRIPTION OF THE DRAWINGS

The present invention will become more fully understood from the following detailed description and the accompanying drawing, which is only illustrative, and is not limiting of the present invention.

DETAILED DESCRIPTION OF A PREFERRED EMBODIMENT

Figure 1:
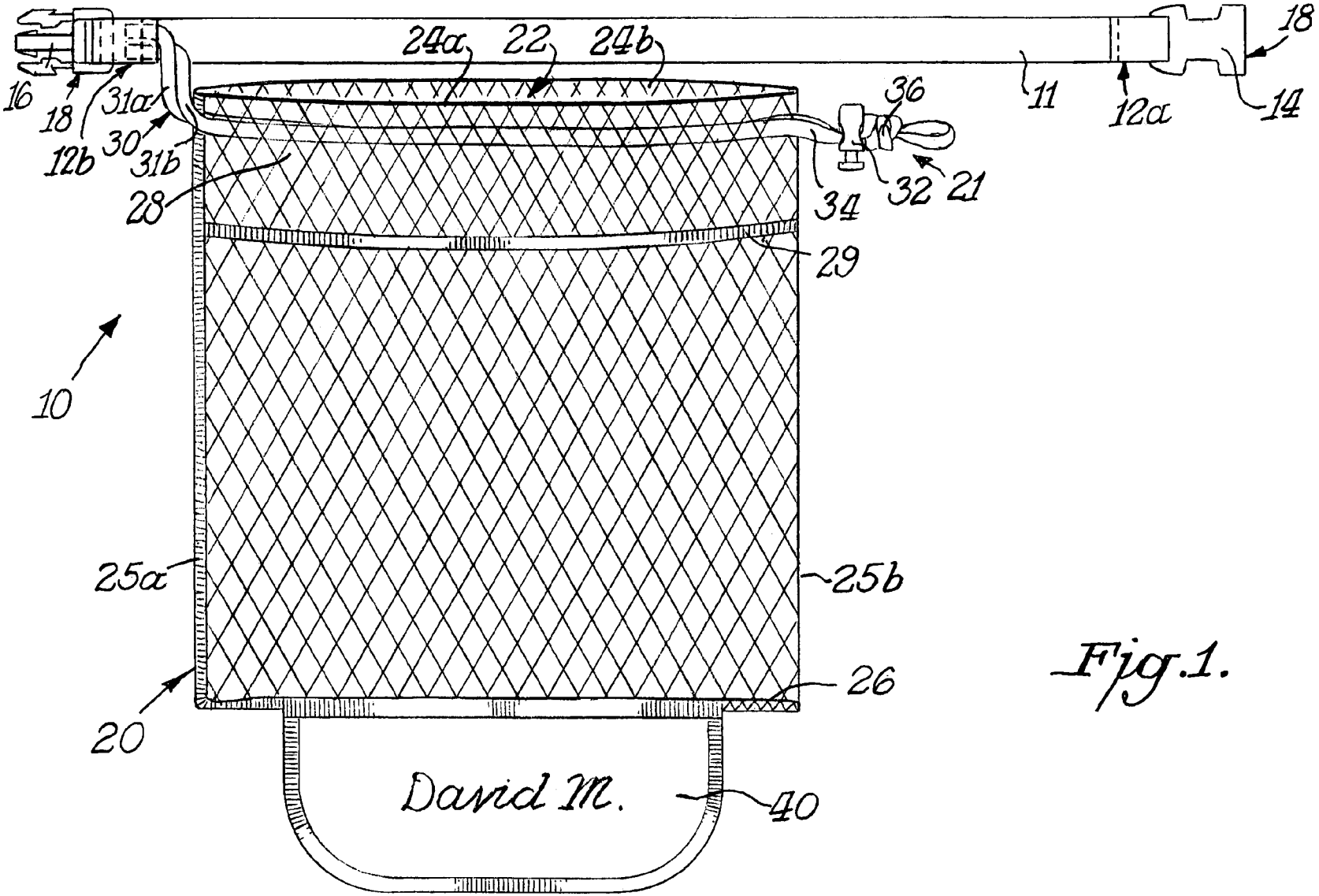
FIG. 1. A schematic view of the laundry retention device embodying the present invention.
Figure 2:
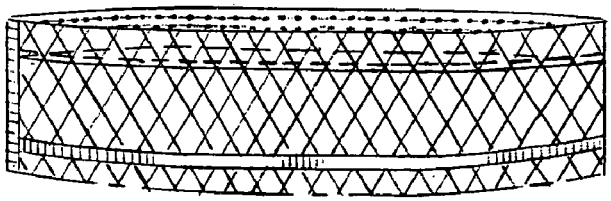
FIG. 2. A partial schematic view of the laundry retention device having a hook and loop strip closure.
Figure 3:
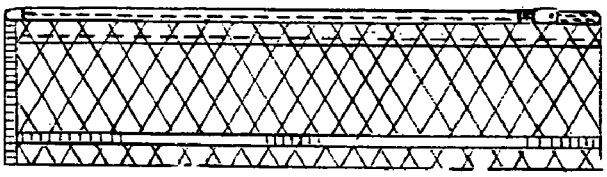
FIG. 3. A partial schematic view of the laundry retention device having a zipper closure.
Figure 4:
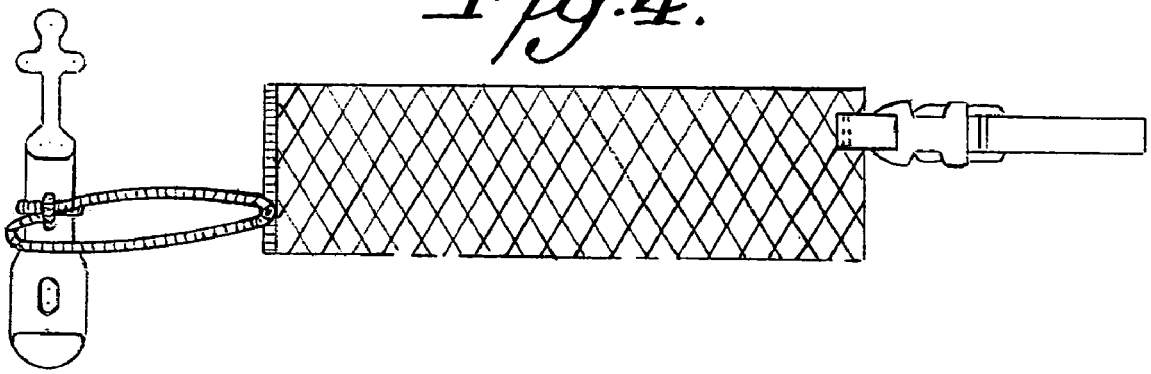
FIG. 4. A partial schematic view of the laundry retention device having a toggle closure.
Figure 5:
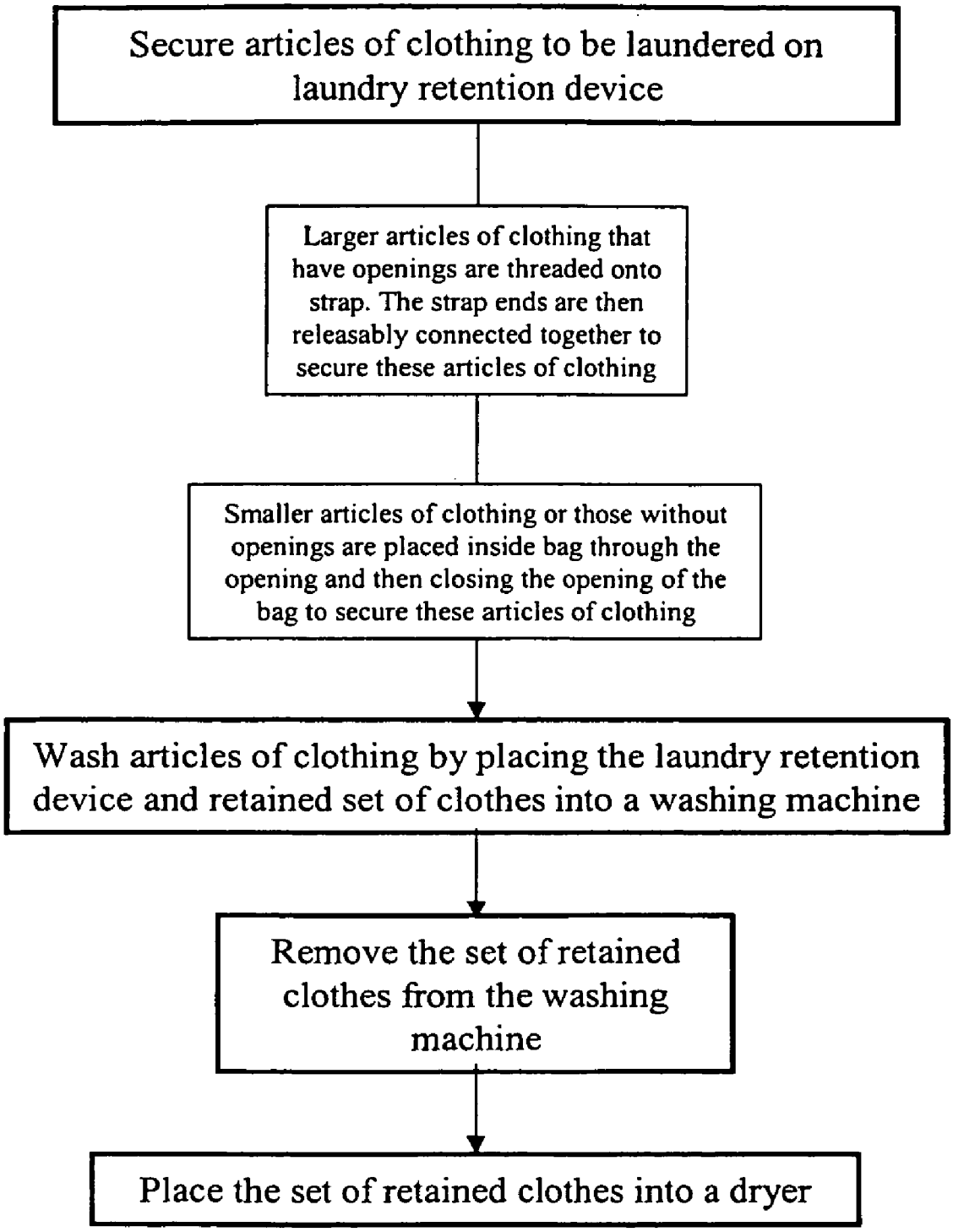
FIG. 5. A flow chart of a method of laundering articles of clothing using the laundry retention device.

An embodiment of the laundry retaining device 10 of the present invention is shown in FIG. 1. In this embodiment, the device 10 comprises a strap 11 having opposing strap ends 12*a* and 12*b*. Attached to one strap end 12*a* is a female side-release fastener 14. Attached to the other strap end 12*b* is a male side-release fastener 16. The female and male side-release fasteners together form a fastener 18 for releasably connecting said opposing strap ends 12*a* and 12*b* of the strap 11.

In a particularly preferred embodiment, the strap 11 may be made from a variety of materials and have a variety of lengths as determined by an ordinarily-skilled artisan. Preferably, the strap 11 is made from nylon and is about three-quarters of an inch in width and 18 inches in length (Part No. N0019, Tape Craft, Anniston, Ala.). Additionally, in this particularly preferred embodiment, the fastener 18 is a FASTEX® SR-¾ squeezable, side-release fastener (Part No. 101-0075-5614, ITW Nexus, Wood Dale, Ill.).

The device 10 further includes a bag 20. The bag can be made of mesh, screen, fabric, perforated fabric, or similar materials known by an ordinarily-skilled artisan to allow for the washing and drying of clothes placed inside the bag. In a particularly preferred embodiment, the bag is a mesh bag.

In the embodiment shown in FIG. 1, the bag 20 is relatively flat when empty and has two edges 25*a* and 25*b* and a bottom 26. The bag 20 has an opening 22, said opening having a pair of opposing opening sides 24*a* and 24*b*. In the preferred embodiment shown in FIG. 1, the opening 22 also has an opening flap 28 that is formed by folding over the top of the bag 20 near the opening 22. In the same illustrated embodiment, the opening flap 28 forms an opening collar 29 by attaching the opening flap 28 to the top of the bag 20 around the perimeter of the opening 22.

The bag 20 has a closure 21 to close said opening 22. The closure 21 can be any means known by an ordinarily-skilled artisan suitable to close a bag for use in laundering clothes. Such a closure 21 includes, but is not limited to: a drawstring; a cord and a cordlock fastener; a conventional zipper; a plastic zipper such as those found in ZIPLOC® bags and ZIPLOC® Easy Zipper bags (S.C. Johnson Home Storage Inc., Racine, Wis.), and those described in Naito, U.S. Pat. No. Re. 28,969, Kirkpatrick, U.S. Pat. Nos. 4,186,786 and 4,285,105, and Dais et al. U.S. Pat. No. 5,140,727 (1992); and hook and loop strips such as VELCRO® hook and loop tapes (Velcro USA Inc., Manchester, N.H.). Depending on the type of closure 21 used in the particular embodiment of the inventions, the closure 21 should either cinch closed the opening 22 or secure the opposing opening sides 24*a* and 24*b* so that clothing articles placed inside the bag 20 do not escape or fall out of the bag during the laundering process. For example, in the case of a convention or plastic zipper closure 21, the zipper is located in the opening 22 so that it will close the opening 22 of the bag 20. In the case of a hook and loop strips closure 21, the hook and loops strips are located in the opening 22 so that they will close the opening 22 of the bag 20.

In the illustrated embodiment shown in FIG. 1, the closure 21 comprises a cord 30 and a releasable cordlock fastener 32. The cord 30 passes around the perimeter of the opening 22 through the opening collar 29. In a particularly preferred embodiment, the cord 30 has a pair of cord ends 31*a* and 31*b*. One cord end 31*a* is attached to one strap end 12*b*. The other cord end 31*b* passes through the opening collar 29 on one of the opening sides 24*a* beginning at the edge of the bag 25*a* that is closest to the strap. The cord end 31*b* then exits the opening collar 29 on the edge of the bag 25*b* that is farthest from the strap end 12*b* and extends outside the opening collar 29 creating a cord tail 34. The cord end 31*b* then passes back through the opening collar 29 along the other opening side 24*b* and attaches to the same strap end 12*b*. In this embodiment, the cord 30 forms a loop that passes through the opening collar 29 around the perimeter of the opening 22. In this same particularly preferred embodiment, the cord tail 34 is threaded through a releasable cordlock fastener 32 and the cordlock fastener 32 is secured on the cord 30 by a knot 36 in the cord 30. In this particularly preferred embodiment, the opening 22 is closed by sliding the cordlock fastener 32 along the loop of cord 30 towards the strap end 12*b* cinching the opening 22 closed. The cordlock fastener 32 prevents the opening 22 from opening during laundering. To open the bag 20, the user slides the cordlock fastener 32 away from the strap end 12*b* allowing the opening 22 to open. Embodiments employing drawstrings, conventional zippers, plastic zippers, and hook and loop strips can be opened and closed using methods known by ordinarily-skilled artisans to be suitable for each closure type.

The bag 20 is attached to the strap 11 using any means known by an ordinarily-skilled artisan. In the illustrated embodiment shown in FIG. 1, the bag 20 attaches to the strap 11 via the cord 30. The cord 30 has two cord ends 31*a* and 31*b*, one cord end 31*a* connects to one strap end 12*b*. The other cord end 31*b* threads through the opening collar 29 along the perimeter of the opening 22 and then the other cord end 31*b* attaches to the same strap end 12*b*. Other embodiments include directly attaching a portion of the bag 20 to the strap by sewing, gluing, heat welding, or similar means. Still other embodiments include attaching the bag 20 to the strap 11 along one opposing side of the opening 24*a* or 24*b*. In such embodiments, the closing means would preferably be a conventional zipper, a plastic zipper, or hook and loop strips as the opening 22 would not be easily cinched closed.

In a particularly preferred embodiment, the bag 20 is a mesh bag and is made from nylon and has an opening 22 of about 9 inches in width measured from one edge 25*a* to the other edge 25*b*. In this same particularly preferred embodiment, the bag 20 measures about 9.5 inches deep from the opening 22 to the bottom 26 and is made of polyester (Part No. TA 97, Apex Mills, Inwood, N.Y.). Further in this same particularly preferred embodiment, the cord 30 is made of nylon and the cordlock fastener 32 is a nylon cordlock fastener ("Toaster Ellipse," Part No. 350-2000, ITW Nexus, Wood Dale, Ill.) and the cord 30 is made of nylon (Part No. 4201, Frankin Braid Co., Emporia, Va.). The length of the cord 30 in this same embodiment is sufficient to allow the opening 22 to fully open and still have a cord tail 34 exposed outside of the opening collar 29.

The illustrated embodiment of FIG. 1 has an identification tag 40 that allows for the identification of each set of clothes that is retained by the device 10. Thus, several sets of clothes can be washed and dried at once, each being identified by the unique markings on the identification tag 40.

To use the device 10, larger articles of clothing that have openings, such as shirts and shorts, are threaded onto the strap 11 by passing one strap end 12*a* through the openings and coupling the strap end with the other strap end 12*b* via the fastener 18. Smaller articles of clothing, or those articles that do not have openings that would allow the strap 11 to pass through them, are placed inside the bag 20 through the opening 22 and then closing the opening 22 with the closure 21.

The device 10 and retained clothes are then placed in a washing machine. Because the clothes are retained on the device 10, several sets of clothes, each set retained on a device 10, can be washed at one time. The individual sets of clothes are then removed from the washer and placed in a dryer. By using the device 10, each set of clothes is maintained during washing and drying. Therefore, the device 10 eliminates the need to sort through the completed laundry to recreate each individual set of clothes.

While the invention has been particularly shown and described with reference to preferred embodiments thereof, it will be understood by those skilled in the art that various changes in form and details may be made without departing from the spirit and scope of the invention as defined in the appended claims.

I claim:

1. A method of laundering articles of clothing comprising:

(a) securing the articles of clothing to be laundered on a laundry retention device comprising:

(i) a strap having opposing strap ends;

(ii) a fastener for releasably connecting said opposing strap ends; and (iii) a bag having an opening and a closure to close said opening of the bag; wherein said bag is directly attached to said strap;

wherein the laundry retention device secures the articles of clothing that have openings by passing one end of the strap through an opening in the article of clothing and coupling the strap end with the other strap end via the fastener, and wherein the laundry retention device secures the articles of clothing that do not have openings to pass the strap through by placing those articles of clothing inside the bag and closing the opening of the bag with the closure; and (b) washing the articles of clothing by placing the laundry retention device and the secured clothes into a washing machine.

2. The method of doing laundry of claim 1 further comprising step (c) placing the laundry retention device and the secured clothes into a dryer.

3. A method of laundering articles of clothing comprising:

(a) securing at least one set of articles of clothing on a laundry retention device comprising:

(i) a strap having opposing strap ends;

(ii) a fastener for releasably connecting said opposing strap ends; and (iii) a bag having an opening and a closure to close said opening of the bag; wherein said bag is directly attached to said strap;

wherein the laundry retention device secures the articles of clothing that have openings by passing one end of the strap through an opening in the article of clothing and coupling the strap end with the other strap end via the fastener, and wherein the laundry retention device secures the articles of clothing tat do not have openings to pass the strap through by placing those articles of clothing inside the bag and closing the opening of the bag with the closure; and (b) washing the at least one set of articles of clothing by placing the laundry retention device and the secured set of clothes into a washing machine.

4. The method of doing laundry of claim 3 further comprising step (c) placing the laundry retention device and the secured set of clothes into a dryer.

* * * * *

UNITED STATES PATENT AND TRADEMARK OFFICE

CERTIFICATE OF CORRECTION

PATENT NO. : 7,275,868 B2
APPLICATION NO. : 11/145049
DATED : October 2, 2007
INVENTOR(S) : David S. Miller It is certified that error appears in the above-identified patent and that said Letters Patent is hereby corrected as shown below:

In the Claims:

In Claim 3, in column 6, on line 40, "secures the articles of clothing tat do not have openings" should read -- secures the articles of clothing that do not have openings --.

Signed and Sealed this

Twenty-fifth Day of December, 2007

JON W. DUDAS
*Director of the United States Patent and Trademark Office*